US010065068B1

(12) United States Patent
Wilson

(10) Patent No.: US 10,065,068 B1
(45) Date of Patent: Sep. 4, 2018

(54) ADJUSTABLE ANKLE REHABILITATION APPARATUS

(71) Applicant: Ralph Valentine Wilson, Mesa, AZ (US)

(72) Inventor: Ralph Valentine Wilson, Mesa, AZ (US)

(73) Assignee: Ralph Valentine Wilson, Mesa, AZ (US)

( * ) Notice: Subject to any disclaimer, the term of this patent is extended or adjusted under 35 U.S.C. 154(b) by 0 days.

(21) Appl. No.: 15/783,581

(22) Filed: Oct. 13, 2017

(51) Int. Cl.

| | |
|---|---|
| ***A63B 23/08*** | (2006.01) |
| ***A63B 23/10*** | (2006.01) |
| ***A63B 21/00*** | (2006.01) |
| ***A63B 4/00*** | (2006.01) |
| ***A63B 26/00*** | (2006.01) |

(52) U.S. Cl.
CPC ..... *A63B 21/4015* (2015.10); *A63B 4/00* (2013.01); *A63B 21/4034* (2015.10); *A63B 23/08* (2013.01); *A63B 26/003* (2013.01); *A63B 2225/09* (2013.01)

(58) Field of Classification Search
CPC ..... A63B 26/00; A63B 26/003; A63B 21/00; A63B 21/02; A63B 21/055; A63B 71/009; A63B 71/0054; A63B 2225/62; A63B 21/40; A63B 4/00; A63B 23/08; A63B 2225/09
See application file for complete search history.

(56) References Cited

U.S. PATENT DOCUMENTS

| | | | | | |
|---|---|---|---|---|---|
| 2,238,084 | A * | 4/1941 | Tuell | A63C 3/12 | 280/825 |
| 2,867,445 | A * | 1/1959 | Lachat | A63C 1/36 | 280/11.12 |
| 2,917,315 | A * | 12/1959 | Mihalik | A63C 1/36 | 280/11.12 |
| 3,944,654 | A * | 3/1976 | Moore | A63B 4/00 | 273/449 |
| 4,826,159 | A * | 5/1989 | Hersey | A63B 26/003 | 482/146 |
| 5,722,919 | A * | 3/1998 | Timmer | A63B 21/0004 | 482/105 |
| 5,897,464 | A * | 4/1999 | Mcleod | A63B 23/08 | 482/132 |
| 5,897,474 | A * | 4/1999 | Romero | A63B 22/14 | 446/396 |
| 6,872,175 | B2 * | 3/2005 | Lin | A63B 21/0004 | 482/121 |
| 7,011,612 | B2 * | 3/2006 | Repking | A63B 22/16 | 482/142 |

(Continued)

*Primary Examiner* — Garrett Atkinson
(74) *Attorney, Agent, or Firm* — Jennings Strouss & Salmon PLC; Michael K. Kelly; Daniel R. Pote

(57) ABSTRACT

Various embodiments provide an adjustable ankle rehabilitation device for rehabilitating torn ligaments associated with a sprained ankle. The rehabilitation device can include a planar platform secured to a shoe, and a balancing rail adjustably attached to the bottom of the platform and extending fore to aft. The balancing rail is configured to selectively place a desired amount of stress on the medial muscle or, alternatively, the lateral muscle by adjusting the balancing rail from side-to-side. The device can include adjustable fasteners to secure the balancing rail at a desired position adjacent the bottom of the platform.

5 Claims, 8 Drawing Sheets

(56) References Cited

U.S. PATENT DOCUMENTS

| | | | | |
|---|---|---|---|---|
| 7,137,938 | B2 | 11/2006 | Gottlieb | |
| 7,357,766 | B2 * | 4/2008 | Langer | A63B 21/0004 482/146 |
| 7,357,767 | B2 | 4/2008 | Tsai | |
| 9,271,895 | B2 * | 3/2016 | Mor | A43B 13/145 |
| 2004/0023766 | A1 * | 2/2004 | Slone | A63B 22/18 482/146 |
| 2007/0117697 | A1 | 5/2007 | Genua | |
| 2010/0035734 | A1 * | 2/2010 | DiGiovanni | A63B 23/085 482/79 |
| 2012/0178599 | A1 | 7/2012 | Rogers | |
| 2013/0116726 | A1 * | 5/2013 | Mor | A43B 13/145 606/204 |
| 2016/0067550 | A1 * | 3/2016 | Breach | A63B 69/0028 36/103 |
| 2017/0128816 | A1 * | 5/2017 | DeMarch | A63B 71/0622 |

* cited by examiner

ADJUSTABLE ANKLE REHABILITATION APPARATUS

TECHNICAL FIELD

The present invention relates, generally, to methods and apparatus for rehabilitating an injured ankle and, more particularly, to a strap-on device having an adjustable balancing rail.

BACKGROUND

The ankle joint facilitates balance, stability, and the ability to bear the body's weight. It must perform these tasks while being exercised and manipulated over one million times a year. Ankle sprains are one of the most common orthopedic injuries, occurring equally in both sexes and across all age groups. These injuries are often reported by athletes; although ankle sprains are also common in those who suddenly trip on a step, slip without warning, or ignore feelings of fatigue during exercise.

Ankle sprains occur in several forms: the high ankle sprain, the medial ankle sprain, the low ankle sprain, and the lateral ankle sprain. The high ankle sprain injures the ligaments connecting the two bones of the lower leg (the tibia and fibula) at the ankle joint. The medial ankle sprain injures the inside ligaments, collectively referred to as the deltoid ligament. The low ankle sprain involves the ligaments supporting the subtalar joint below the tibiotalar joint or "true ankle joint". The lateral sprain occurs when the foot rolls inwardly, damaging the lateral ligaments. The majority of ankle sprains occur at the lateral (outside) side of the true ankle joint.

The treatment for most ankle sprains includes rest, ice, compression and elevation, followed by rehabilitation and muscle strengthening. Since most practitioners believe that ligaments heal best with minimal stress, recovery plans typically protect the ankle with a brace and limit weight on the ankle while walking, which may require crutches.

In some cases, physical therapy may be needed to strengthen the ankle and restore the full range of joint movement. Recovery from an ankle sprain is considered complete when the ankle function is fully restored, and joint stability and strength have been regained. This suggests that recovery is not complete until routine activities, including sports, can be resumed without soreness, swelling or pain. The length of time for recovery from an ankle sprain depends on the severity of the injury.

During recovery, the ankle may be vulnerable to another sprain or even a more serious ankle injury. Stretching before activity, strengthening the muscles of the lower leg, and improving balance will help to reduce the risk of injury. Strong muscles will reduce the risk of injury.

Various exercises have been developed to strengthen and/or stretch the muscles of the leg, which can be integrated into a recovery plan, a post-recovery rehabilitation, or an injury prevention routine. A balance board is a popular device used to strengthen and stabilize the ankle. In addition, stretch bands or resistance bands can be used for a variety of different exercises for strengthening the muscles of the ankle joint.

Presently known therapeutic devices focus on groups of muscles and are not designed to focus on the particular muscle damaged by an ankle injury. Since healthy muscles can compensate for an injured ligament, ankle exercises typically strengthen the muscles surrounding the injured ligament, which can leave the joint at risk for a subsequent injury.

Current ankle exercise devices are limited to use in a particular location such as, a gym or a home. Consequently, such devices are typically used to strengthen the muscles for short periods of time, such as once a day or a couple times a week. If these devices were able to be integrated into daily activities, recovery times could be shortened and improvements in muscle strength and balance could be accelerated.

Systems and methods are thus needed which overcome these limitations. Various desirable features and characteristics will also become apparent from the subsequent detailed description and the appended claims, taken in conjunction with the accompanying drawings and this background section.

BRIEF SUMMARY

Various embodiments of the present invention relate to an adjustable ankle rehabilitation apparatus for rehabilitating a torn ankle ligament. The rehabilitation apparatus may include a planar platform into which a user's shoe is strapped, and an elongated balancing rail adjustably attached to the underside of the platform. The balancing rail is adjustable from side-to-side, which allows a user to place more or less stress on the medial side or the lateral side ligaments while walking or standing. The balancing rail may be square or rectangular in cross-section, with opposing flat surfaces abutting against the bottom of the platform and the floor, respectively. The planar platform can include different arrangements for accommodating various foot sizes, such as multiple strap locations for securely fastening to wider or narrower shoe widths.

Some embodiments provide an adjustable ankle rehabilitation device configured for engagement onto a foot. The device can be constructed using a sole plate which may extend laterally and longitudinally beyond the foot with a rear heel stop to keep the foot from sliding off. The sole plate can include a pair of parallel channels having closed ends, which are transverse (e.g., perpendicular) to a center line along the length of the sole plate. The device can include a moveable balance beam attached through the channels to the sole plate and positioned perpendicular to the channels.

Threaded holes can be disposed within the balance beam and configured for alignment with the channels. The balance beam may be attached to the sole plate using any type of fastener, which can be placed in one of the channels to engage the corresponding holes in the balance rail. The device can include adjustable straps, which may be secured to the sole plate and configured to maintain the sole plate adjacent to the bottom of the foot.

Various other embodiments, aspects, and features are described in greater detail below.

BRIEF DESCRIPTION OF THE DRAWING FIGURES

Exemplary embodiments will hereinafter be described in conjunction with the following drawing figures, wherein like numerals denote like elements, and:

The drawings described herein are for illustrative purposes only of selected embodiments and not all possible implementations, and are not intended to limit the scope of any of the exemplary embodiments disclosed herein or any equivalents thereof.

DETAILED DESCRIPTION

The following detailed description of the invention is merely exemplary in nature and is not intended to limit the invention or the application and uses of the invention. Furthermore, there is no intention to be bound by any theory presented in the preceding background or the following detailed description.

The most common type of ankle sprain involves hyper inversion, which damages the lateral ankle ligaments. The objective of rehabilitation is to regain full function of the ankle without limitations, especially for athletes who need to return to their prior level of physical activity.

The recovery and rehabilitation process for an ankle injury typically includes the gradual strengthening of muscles, and healing of the ligaments associated with or located near the injury. Such muscles are often associated with maintaining balance (proprioception), and can be strengthened by the use of a device that requires balance and improves proprioception. For both rehabilitation and overall strengthening applications, it is desirable to gradually increase the difficulty of the balancing exercise, as balance improves.

Figure 1:
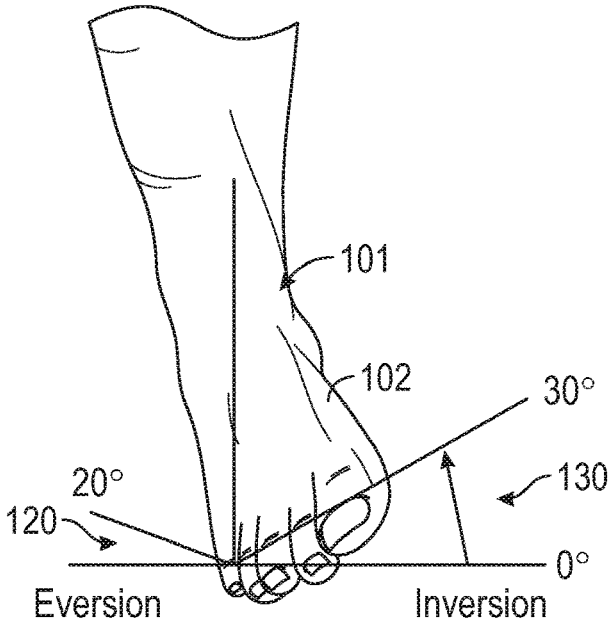
FIG. 1 is a front view of an ankle in accordance with various embodiments.

With reference to FIG. 1, the movement of an ankle 101 in the z-axis is illustrated. Inversion 130 and eversion 120 refer to movements that tilt the sole of the foot 102 away from (eversion 120) or towards (inversion 130) the midline of the body. In general, the range of motion is about 20 degrees for eversion and about 30 degrees for inversion. However, athletes and those who regularly exercise, stretch, and/or engage in yoga will typically have a greater range of motion in both the eversion and the inversion directions. The majority of ankle sprains are caused by inversion 130 (commonly referred to as "rolling your ankle").

A rehabilitation plan is intended to increase both range of motion and strength. Early in rehabilitation, limited weight bearing on the injured ankle can reduce muscle atrophy, and proprioceptive loss. For these reasons, early ambulation is typically recommended, even if only touchdown weight bearing is considered.

Range of motion exercises focused on plantar flexion and dorsal flexion can be implemented from the beginning. As swelling and pain diminish, exercises focused on inversion and eversion can be implemented. Eversion and inversion exercises can help regain movement and stability after an injury. Following a typical rehabilitation plan for an ankle sprain, strengthening of the muscles can be carried out by a progression of isometric and isotonic exercises to isokinetic exercises as pain diminishes.

In various embodiments, an adjustable ankle rehabilitation device (apparatus) can include a planar platform configured for attachment to a shoe, and a balancing rail adjustably attached to the bottom of the platform and extending from heel-to-toe. The balancing rail is configured to place more or less stress on the medial ligament or the lateral ligament by adjusting the balancing rail from one side of the platform to the other side of the platform. The device can include adjustable fasteners to secure the balancing rail at a desired lateral position on the bottom of the platform. The fasteners can be loosened to move the balancing rail from one side of the platform to the other side of the platform along a channel, as described below.

The balancing rail can be secured along a longitudinal center line of the platform, which places the rehabilitation apparatus in a neutral position (e.g., midway between the left and right ends of the channel). In the neutral position, isometric exercises can be performed. For example, a user, who is balancing on the rehabilitation apparatus in the neutral position, has to work lateral muscles to raise the lateral side of the platform and has to work medial muscles to raise the medial side of the platform. Such isometric exercises can also improve proprioception.

The neutral position is the starting point for walking in the rehabilitation apparatus. The rehabilitation apparatus in the neutral position can strengthen the muscles on both sides of the ankle while walking.

In some aspects of the rehabilitation apparatus, the balancing rail can be secured onto a medial side of the platform, which places the apparatus in a medial position. In the medial position, isometric exercises can be performed. For example, a user, who is balancing on the rehabilitation apparatus in the medial position, has to work lateral muscles to keep the lateral side of the platform parallel to the ground. Such isometric exercises can improve strength and proprioception.

In some aspects of the rehabilitation apparatus, the balancing rail can be secured onto a lateral side of the platform, which places the apparatus in a lateral position. In the lateral position, isometric exercises can be performed. For example, a user, who is balancing on the rehabilitation apparatus in the lateral position, has to work medial muscles to keep the medial side of the platform parallel to the ground. Such isometric exercises can improve strength and proprioception.

Some embodiments provide an ankle strengthening and rehabilitation device. A first channel and a second channel extend through a foot plate. The first channel is located in a fore region of the foot plate and extends transversely across a portion of a width of the foot plate. A second channel is located in the aft region parallel to the first channel. A pair of fasteners releasably secures the balance bar to the foot plate through the channels and along a longitudinal axis on the bottom of the foot plate. To slide the balance bar to a second longitudinal position, the pair of fasteners are loosened and moved through the channels, then re-tightened to secure the balance bar in a selected position. The device can include at least one attachment mechanism configured to secure a foot onto a top surface of the foot plate.

Referring now to FIGS. 2-7, various aspects of an adjustable ankle rehabilitation apparatus 300 will now be described in detail. For clarity, shoe 320 is not an element of the adjustable ankle rehabilitation apparatus 300; however, the shoe 320 is included in some of the drawings to illustrate its engagement with the apparatus 300.

Figure 2:
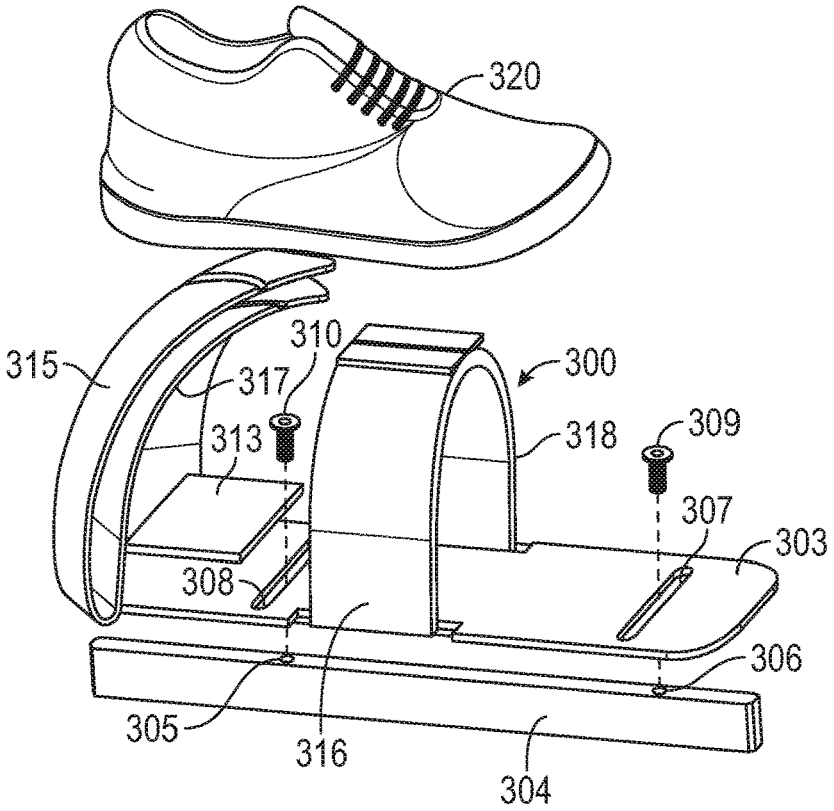
FIG. 2 is a side fragmented view an exemplary adjustable ankle rehabilitation apparatus in accordance with various embodiments.

More particularly, FIG. 2 is a side fragmented view of an adjustable ankle rehabilitation apparatus 300. A planar platform 303 preferably exhibits a length greater than a length of the shoe 320 and a width greater than the width of the shoe 320. In an embodiment, planar platform 303 is a sole plate configured for engagement with the shoe 320.

In the illustrated embodiment, the planar platform 303 has two slots or channels 307, 308, which are parallel to each other. The slots 307, 308 have closed ends on both sides. The slots 307, 308 exhibit a length less than the width of the planar platform 303, and extend through the planar platform 303. The slots 307, 308 are wide enough to allow fasteners 309, 310 to pass through the slots 309, 310.

In the embodiment shown in FIG. 2, the balance bar 304 (also referred to herein as a "balancing rail" or "balance beam") is rectangular (e.g., square) in cross-section. The balance bar 304 extends from a toe region of the shoe 320 to heel region of the shoe 320.

The fasteners 309 may take the form of threaded screws configured to be aligned with the slots 307, 308 and engage corresponding threaded holes 305, 306 disposed within the balance bar 304. The balance bar 304 may be secured to the planar platform 303 by threading them into the holes 305, 306.

The adjustable ankle rehabilitation apparatus 300 may also include adjustable straps 315, 316, 317, 318 configured to releasably secure the planar platform 303 to the user's foot or shoe. The adjustable straps 315, 316, 317, 318 are configured to hold a bottom of the shoe 320 adjacent to the top surface of the planar platform 303. Adjustable heel straps 315, 317 are configured to hold the heel portion of the shoe 320 proximate the aft position on the planar platform 303. Heel strap 315 and heel strap 317 can be connected together using Velcro or any other appropriate releasable fastening device. Adjustable toe-box straps 316, 318, are configured to hold the front portion of the shoe 320 proximate the fore position on the planar platform 303. Toe-box straps 316, 318 can be connected together using Velcro or any other appropriate releasable fastening device.

Figure 3:
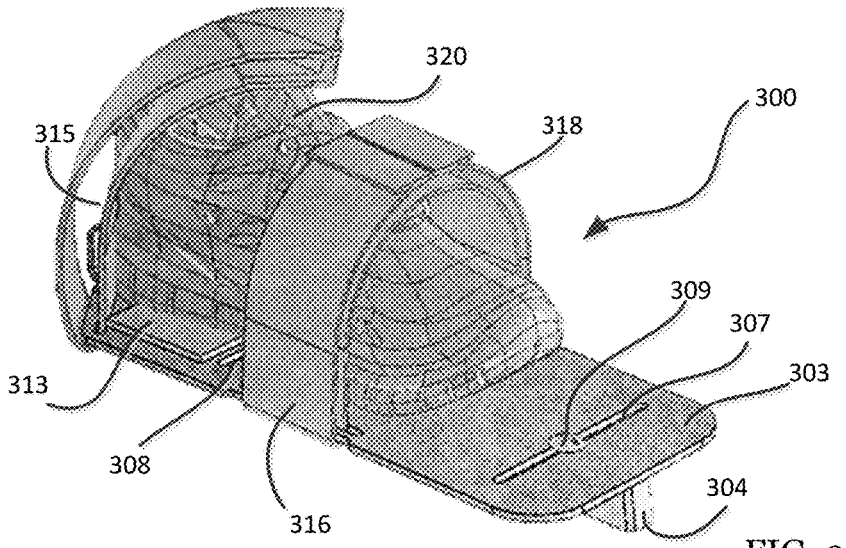
FIG. 3 is a perspective view of the adjustable ankle rehabilitation apparatus of FIG. 3 secured to a shoe in accordance with various embodiments.

FIG. 3 is a perspective view of the adjustable ankle rehabilitation apparatus 303 secured to a shoe 320. The balance bar 304 is coupled to the planar platform 303 such that a top surface of the balance bar 304 abuts a bottom surface of the planar platform 303.

The heel straps 315, 317 are connected to each other around an upper portion of the shoe 320, which holds the heel portion of the shoe 320 in a rearward position on the planar platform 303. The toe-box straps 316, 318 are connected to each other over the toe-box portion of the shoe 320, which holds the front portion of the shoe 320 in a forward position on the planar platform 303.

Pad 313 can be placed on the top surface of the planar platform 303. It is contemplated that the pad 313 can be of any shape, can be placed anywhere on the top surface of the planar platform 303 and any number of pads 313 can be utilized. In some aspects, the pad 313 lifts the bottom of the shoe 320 above a head portion of one of the fasteners 309, 310 which projects above the plane of the platform. In some aspects, the pad 313 provides cushion between the shoe 320 and the planar platform 303. In some aspects, the pad 313 provides enhanced friction between the shoe and the planar platform 303.

Figure 4:
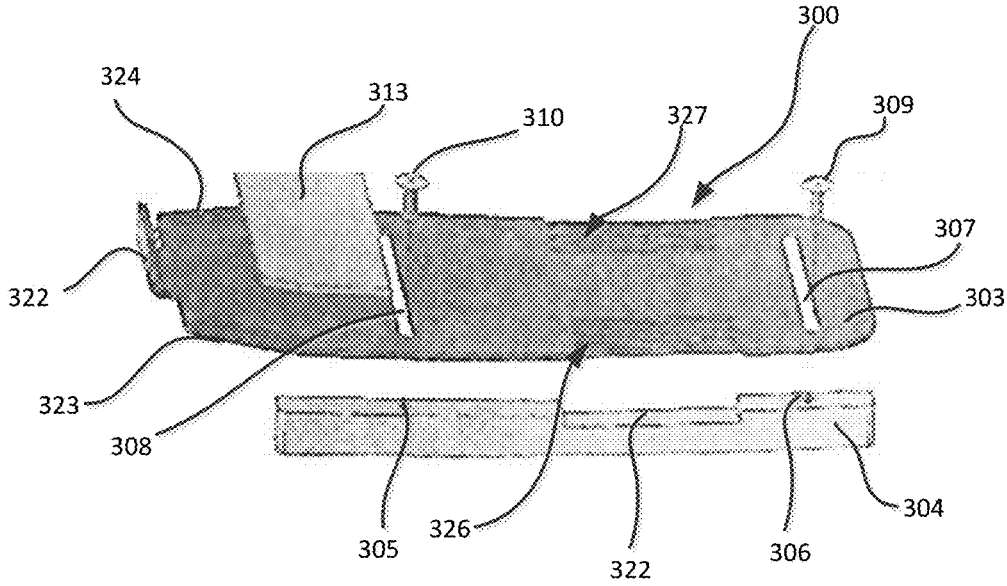
FIG. 4 is a side fragmented view of an exemplary sole plate and associated balance beam in accordance with various embodiments.

FIG. 4 is a fragmented view of the planar platform 303 and the balance bar 304. As discussed herein, the balance bar 304 may be rectangular in cross-section and extend lengthwise beyond both of the slots 307, 308. The balance bar 304 comprises a pair of threaded holes 305, 306, which are spaced to line up with the slots 307, 308 in planar platform 303. The fasteners 309, 310 connect the balance bar 304 to the planar platform 303.

In some configurations, a recess 321 can be placed into the top surface of the balance bar 304. The recess 321 can be configured to allow passage of an adjustable toe-box strap, such as a single contiguous piece. The recess 321 has a length greater than a width of the adjustable toe-box strap. The recess 321 can have a depth which is substantially equal to or slightly greater than a thickness of the adjustable toe-box strap to facilitate manual alignment of the strap within the recess 321.

Figure 5:
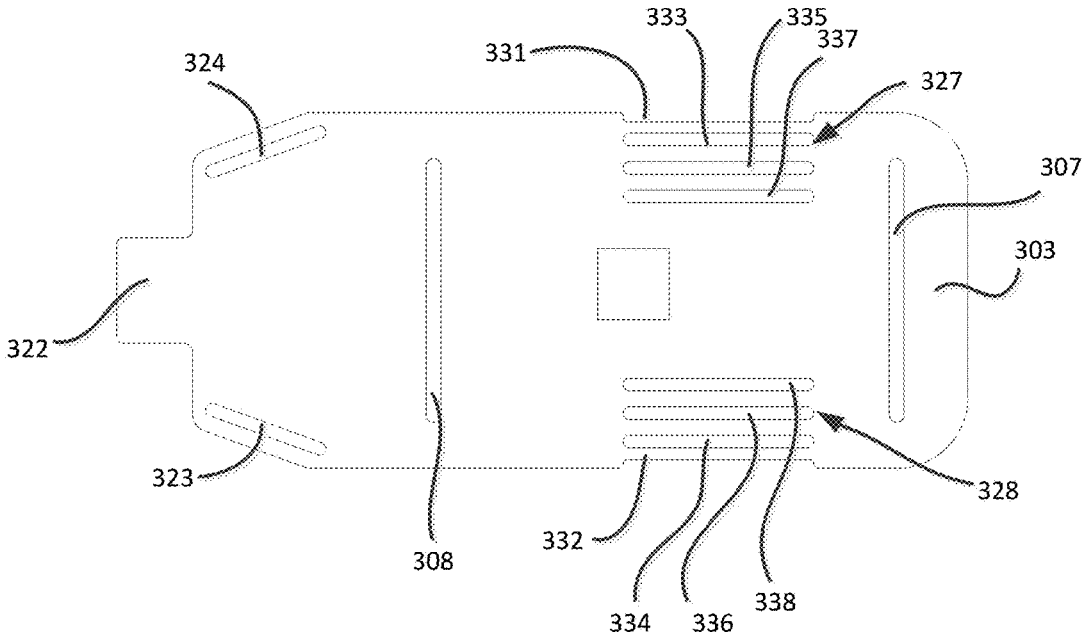
FIG. 5 is a top plan view of an exemplary sole plate in accordance with various embodiments.

With continued reference to FIG. 4 and also referring to FIG. 5, some embodiments provide an adjustable ankle rehabilitation apparatus 300 comprising a heel stop 322 on the aft end of the planar platform 303. The heel stop 322 is configured to hold the shoe 320 in position on the planar platform 303 when the straps 315, 317 are connected together around an upper portion of the shoe 320.

A pair of heel strap anchor apertures 323, 324 is located toward the aft section of the planar platform 303. The heel strap apertures 323, 324 are configured to receive adjustable heel straps 315, 317, to secure the shoe to the planar platform 303. In some configurations, the heel strap apertures 323, 324 are slots machined (e.g., stamped) into the planar platform 303. The heel strap apertures 323, 324 can be disposed at an acute angle relative to the longitudinal axis of the platform.

A plurality of toe-box strap anchor apertures 327, 328 are located at each side of the forward section of the planar platform 303. Corresponding toe-box strap anchor straps (not shown in FIG. 5) are configured to connect the shoe to the planar platform 303.

In some configurations, respective lateral position indicators on the slots 307, 308 comprise a plurality of indices, which may display visual indicia at a center position and a plurality of equally spaced indicia on either side of the center position. In one example, indicia can be placed across each of the slots 307, 308 at the center position and indexed as 0

(zero). The additional indices can then be placed across each of the slots 307, 308 in increments of 5 mm (five millimeters) in either direction from the center point and indexed sequentially with whole numbers. The position indicators can be utilized for positioning the fasteners 309, 310 at equal distances from the center position, which ensures the balance bar 304 is properly aligned (for example, parallel to a longitudinal axis of the planar platform 303). A rehabilitation plan or a practitioner can use the positioning indicia to define the correct lateral position of the balance bar 304 for a various exercises as strength and balance improve.

With continued reference to FIG. 5, a top view of the planar platform 303 with flat heel stop 322 is illustrated. In this configuration of the planar platform 303, the heel stop 322 has not been bent into an angled position substantially orthogonal to the planar platform 303.

In some configurations, the toe-box strap apertures include a pair of wide toe-box strap anchor apertures 333, 334, a pair of medium width apertures 335, 336, and a pair of narrow apertures 337, 338. The straps 315, 317 can be moved between the apertures based on the width of the shoe 320. A pair of recesses 331, 332 protects the adjustable toe-box straps 315, 317.

Figure 6:
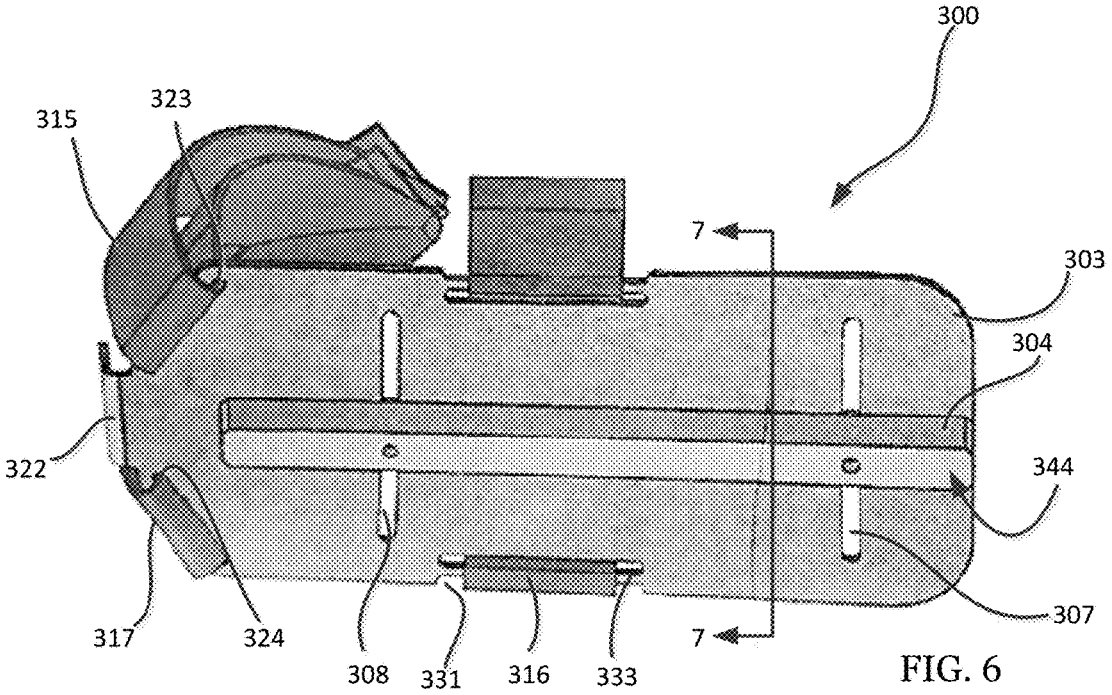
FIG. 6 is a bottom view of the adjustable ankle rehabilitation apparatus of FIG. 3 in accordance with various embodiments.
Figure 7:
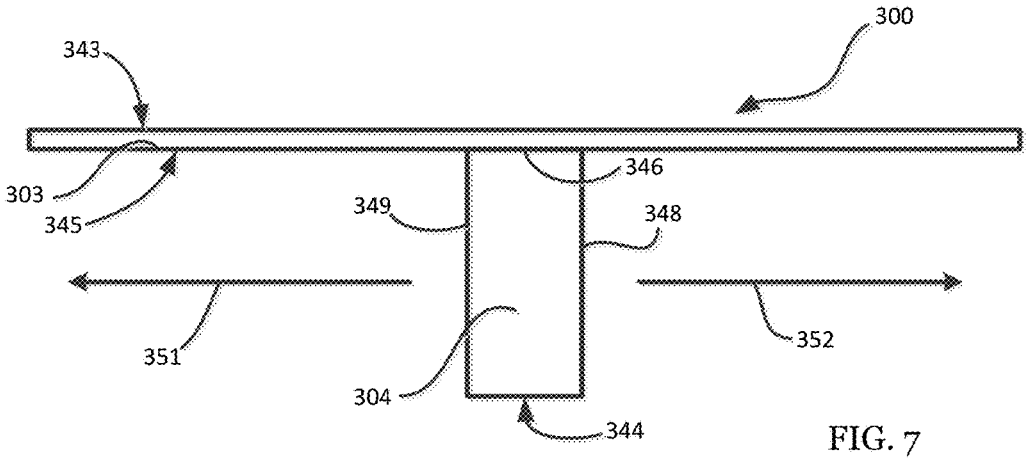
FIG. 7 is a schematic cross-sectional view taken along the line 7-7 of FIG. 8 in accordance with various embodiments.

FIG. 6 illustrates the bottom surface 344 of the balance bar 304. With reference to FIG. 7, a schematic cross-sectional view along the line 7-7 of the adjustable ankle rehabilitation apparatus 300 depicts a top surface 343 and a bottom surface 345. In this illustration, the cross-section of the balance beam 304 is rectangular. A top flat surface 346 of the balance beam 304 abuts against the bottom surface 345 of the planar platform 303. A bottom flat surface 344 of the balance beam 304 is configured for contact with the ground or a floor.

The balance beam 304 has a medial side 348 and a lateral side 349. The balance beam 304 can be moved from a neutral position to any position in the lateral direction 351. Alternatively, the balance beam 304 can be moved from a neutral position to any position in the medial direction 352.

As discussed herein, the fasteners may be configured to slide within the slots as the balance beam 304 is moved to a new position. The fasteners may be tightened after the balance beam 304 has been placed in the selected position. In a preferred embodiment the balance beam 304 remains parallel to the longitudinal axis of the planar platform 303.

In the following FIGS. 8-11, the lateral side of the apparatus 300 is labeled "L" and the medial side of the apparatus 300 is labeled "M".

Figure 8:
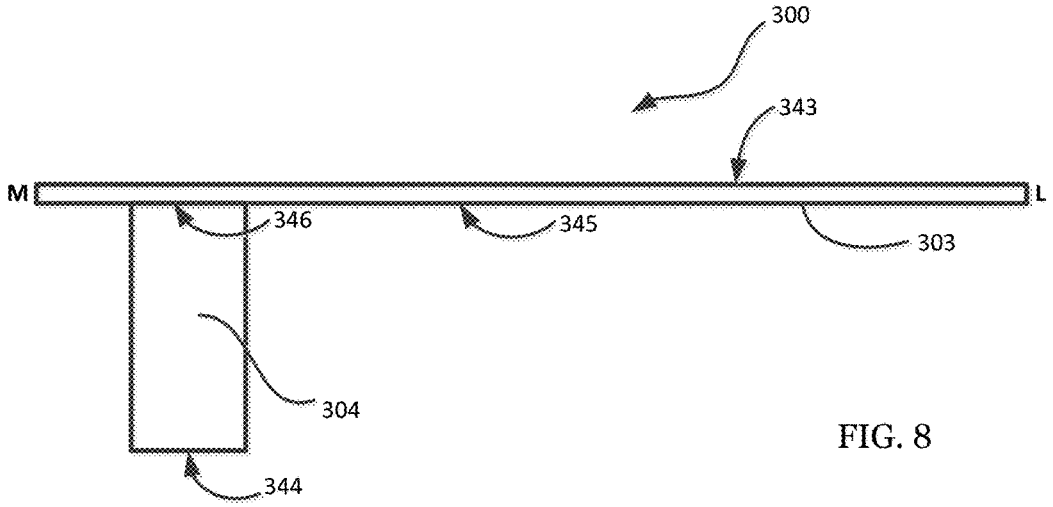
FIG. 8 is a schematic front view of the adjustable ankle rehabilitation apparatus illustrating the balance beam secured within the medial side (medial position) of the channel in accordance with various embodiments.

Referring now to FIG. 8, a schematic front view of the adjustable ankle rehabilitation apparatus 300 illustrates the balance beam 304 in a medial position (e.g., for the left ankle). The apparatus 300, as illustrated, is set for eversion exercises for the left ankle. The rehabilitation apparatus 300, as illustrated, can be used for walking, which promotes eversion exercises. In a rehabilitation plan, the balance bar 304 would gradually be moved further in the medial direction as the user's strength and balance improves.

Figure 9:
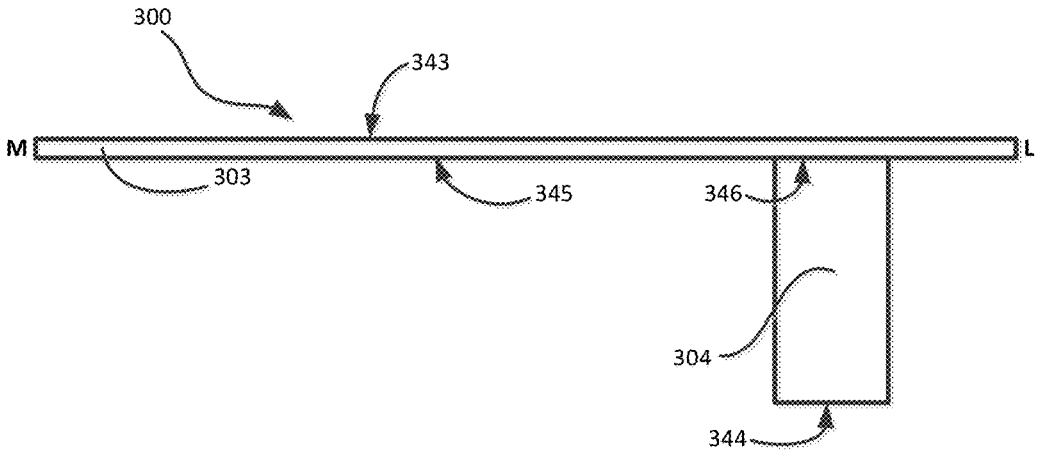
FIG. 9 is a schematic front view of the adjustable ankle rehabilitation apparatus illustrating the balance beam secured within the lateral side (lateral position) of the channel in accordance with various embodiments.

Referring now to FIG. 9, a schematic front view of the adjustable ankle rehabilitation apparatus 300 illustrates the balance beam 304 in a lateral position (e.g., for a left ankle). The apparatus 300, as illustrated, is set for inversion exercises for the left ankle. The rehabilitation apparatus 300, as illustrated, can be used for walking in, which promotes inversion exercises. In a rehabilitation plan, the balance bar 304 would gradually be moved further in the lateral direction as the user's strength and balanced improves.

Figure 10:
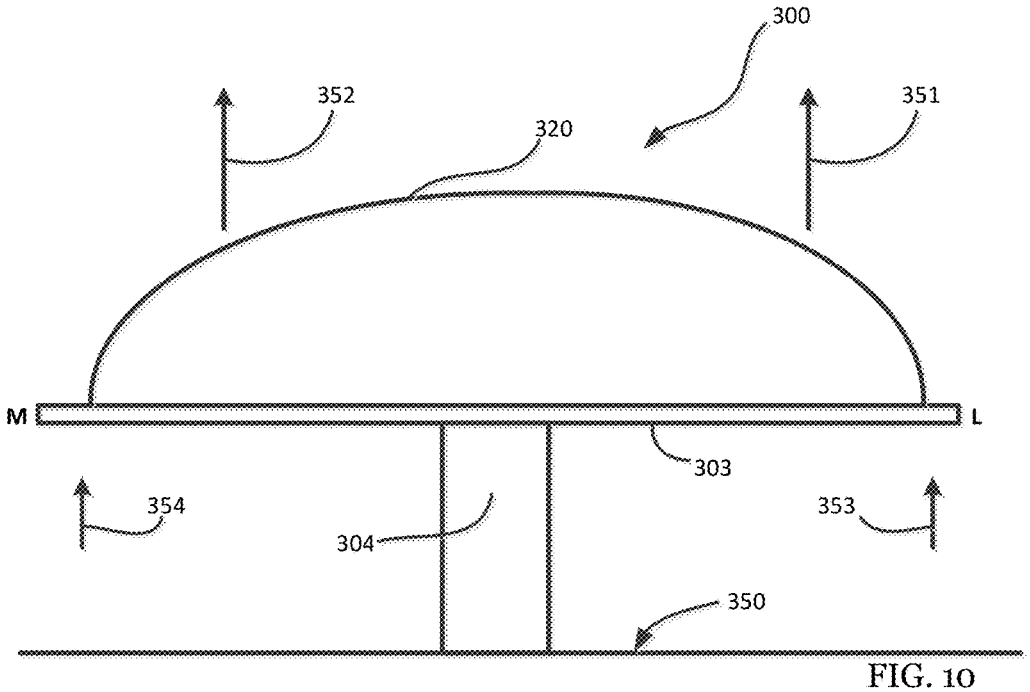
FIG. 10 is a schematic front view of the adjustable ankle rehabilitation apparatus illustrating the balance beam secured within a central (neutral) position of the channel and engaging a shoe in accordance with various embodiments.

FIG. 10 is a front view of the adjustable ankle rehabilitation apparatus 300 secured to a left shoe 320. The balance beam 304 is attached to the planar platform 303 and is in contact with the ground 350. Since the balance beam 304 is at or near the center of the planar platform 303, the rehabilitation apparatus 300 is in a neutral position. In the neutral position, isometric exercises can be performed. For example, a user has to work lateral muscles (in the direction of arrow 351) to raise the lateral side (in the direction of arrow 354), and the user has to work medial muscles (in the direction of arrow 352) to raise the medial side (in the direction of arrow 353). Such isometric exercises can also improve proprioception. With respect to isokinetic exercises, the neutral position is the starting point for walking in the rehabilitation apparatus 300.

Figure 11:
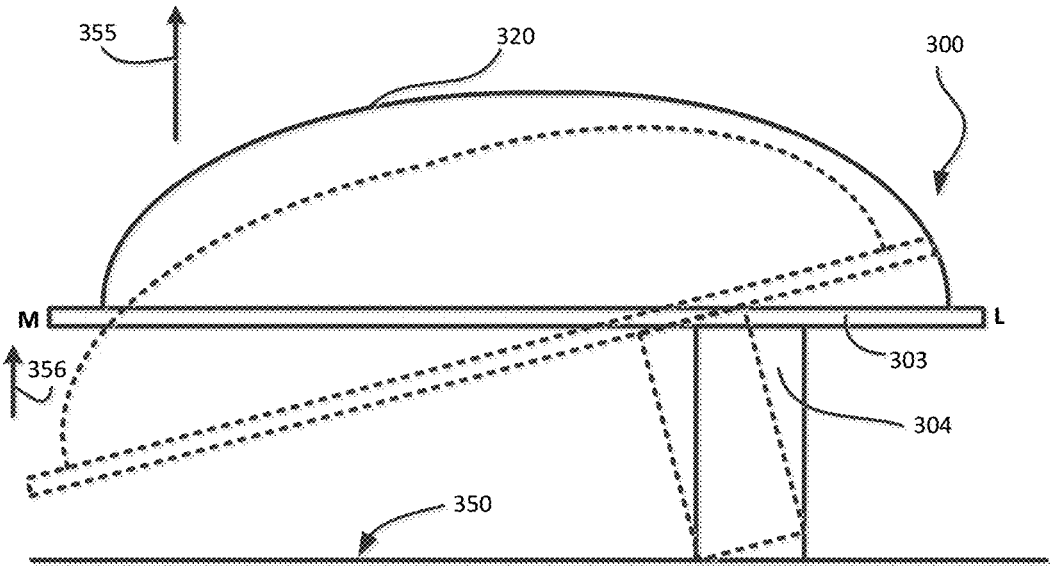
FIG. 11 is a schematic front view of the adjustable ankle rehabilitation apparatus illustrating an exemplary method of use in accordance with various embodiments.

Now with reference to FIG. 11, a method of use is illustrated from a front view of the adjustable ankle rehabilitation apparatus 300 secured to the left shoe 320. The balance beam 304 is shown in a lateral position and the apparatus 300 is set for inversion exercises for the left ankle. The hashed line apparatus and foot are shown at an angle with the medial side resting on the ground 350. The user has to contract the medial muscles (in the direction of arrow 355), which will raise the medial side (in the direction of arrow 354) and bring the planar platform 303 parallel to the ground 350. For isotonic exercises, the user can repeatedly work the medial muscles to bring the planar platform parallel to the ground 350, and thereafter gradually relax the medial muscle to allow the medial side to fall towards the ground.

Figure 12:
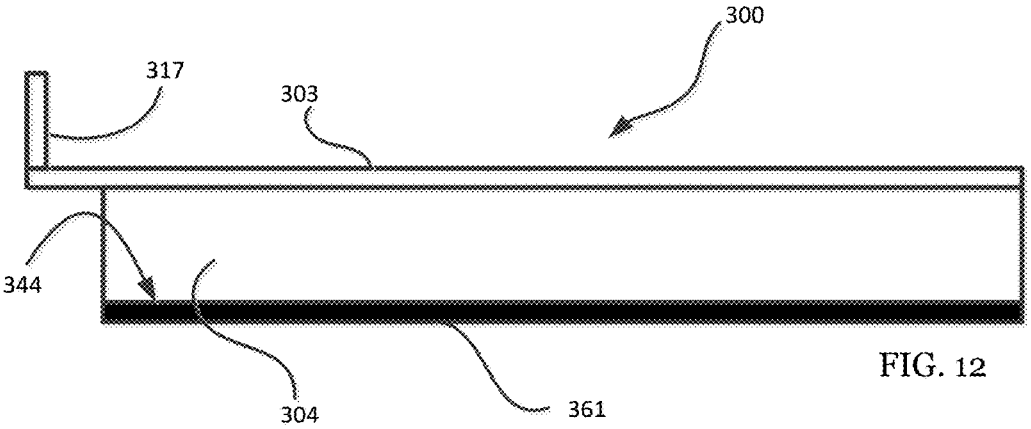
FIG. 12 is a schematic side view of an alternative configuration of the balance beam in accordance with various embodiments.

Turning to FIG. 12, a side view of an alternative embodiment of the balance beam 304 depicts a level traction layer 361 connected to the bottom flat surface 344 of the balance beam 304 and configured to increase the coefficient of friction between the bottom flat surface 344 and the surface the device contacts.

In some aspects, the traction layer 361 may comprise a resilient material configured to absorb impact. In some aspects, a bottom of the traction layer 361 can have a tread pattern imprinted on it. The traction layer 361 can be made from vulcanized rubber (natural or synthetic), thermoplastics, polyurethane, or any other appropriate material. In some configurations, the traction layer 361 is a coating applied to the bottom surface 344 of the balance beam 304.

Figure 13:
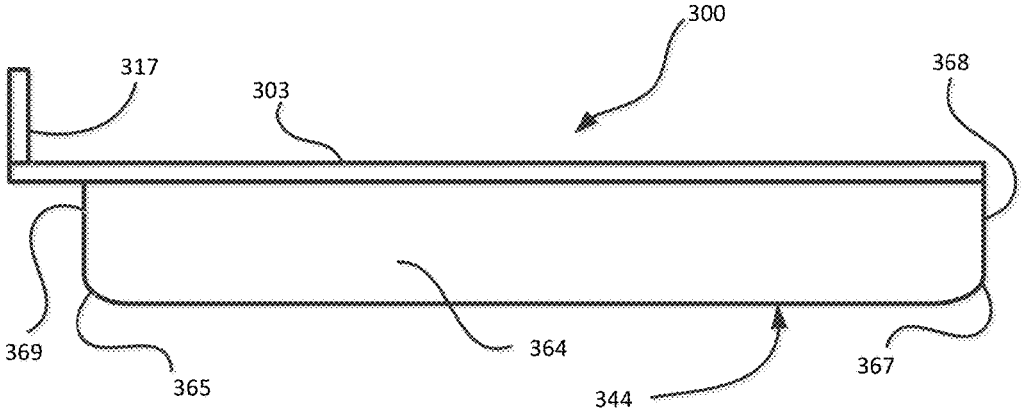
FIG. 13 is a schematic side view of a second alternative configuration of the balance beam in accordance with various embodiments.

FIG. 13 is a side view of a second alternative embodiment of balance beam 304. The balance beam 304 can include two rounded surfaces 365, 367, which connect the front and the rear of the balance beam 304 to the bottom flat surface 344. In some configurations, the balance beam 364 can include a first rounded surface 367 connecting the bottom flat surface 344 to a front surface 368 of the balance beam 364 and a second rounded surface 365 connecting the bottom flat surface 344 to a rear surface 369 of the balance beam 364. The rounded surfaces 365, 367 make the apparatus 300 easier to walk in. In addition, the rounded surfaces 365, 367 are less damaging to flooring material. In another configuration, the rounded surfaces 365, 367 are replaced with a chamfer.

Figure 14:
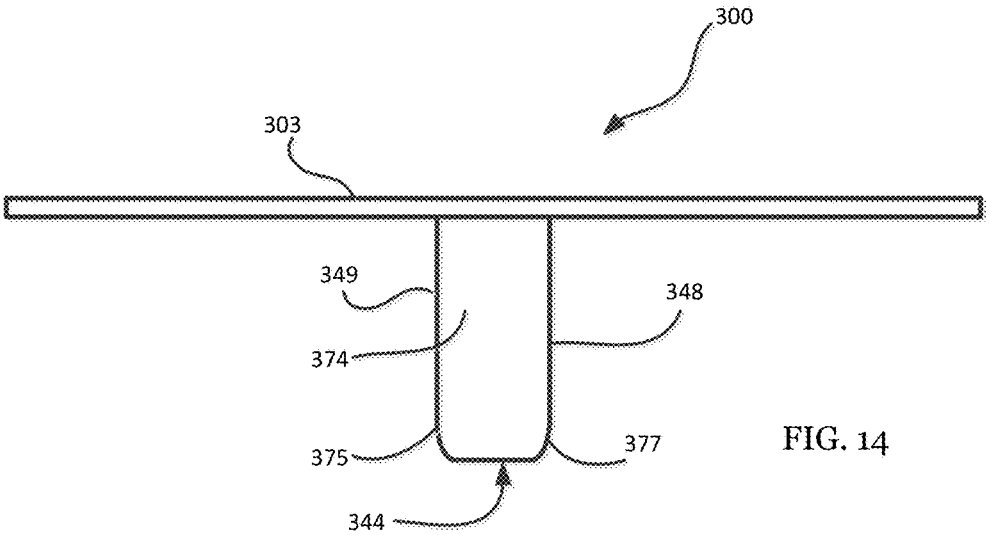
FIG. 14 is a schematic front view of a third alternative configuration of the balance beam in accordance with various embodiments.

FIG. 14 is a front view of a third alternative configuration of balance beam 304. The balance beam 304 can include two rounded surfaces 375, 377 connecting the bottom flat surface 344 to each side surface 348, 349 of the balance beam 304. In some configurations, the balance beam 374 can include a first rounded surface 375 connecting the bottom flat surface 344 to a medial side surface 349 of the balance beam 374, and a second rounded surface 377 connecting the bottom flat surface 344 to a lateral side surface 348 of the balance beam 374. In another configuration, the rounded surfaces 375, 377 are replaced with a chamfer.

Figure 15:
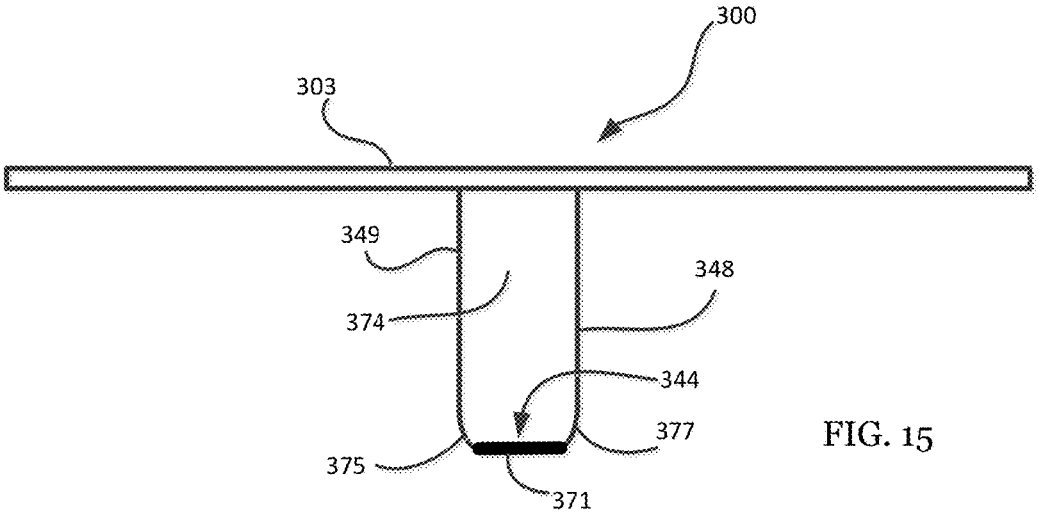
FIG. 15 is a schematic front view of a fourth alternative configuration of the balance beam in accordance with various embodiments.

And finally with reference to FIG. 15, a front view of a fourth alternative configuration of balance beam 304 of the adjustable ankle rehabilitation apparatus 300 is illustrated. In some configurations, the balance beam 304 can include two rounded surfaces 375, 377 connecting the bottom flat surface 344 to each side surface 348, 349 of the balance beam 304. In addition, the balance beam 374 can include a level traction layer 371 coupled to the bottom flat surface 344 and configured to increase the friction of the bottom flat surface 344. The edges of the level traction layer 371 can also be rounded. The two rounded surfaces 375, 377 can include each edge of the traction layer 371. In some configurations, the balance beam 304 can include two rounded surfaces 375, 377 connecting a bottom surface of the traction layer 371 to each side surface 348, 349 of the balance beam 304.

Any combination of the elements from the alternative embodiments illustrated in FIGS. 12-15 is within the scope of the invention disclosed herein.

Various embodiments provide an adjustable ankle rehabilitation apparatus. The apparatus comprises: a planar platform having a top surface, a bottom surface, and first and second lateral slots; an elongated balancing rail adjustably attached to the bottom surface and extending from a toe portion of the planar platform to a heel portion; and a first fastener configured to extend through the first slot and a second fastener configured to extend through the second slot to thereby releasably secure the balancing rail within a predetermined lateral position adjacent the bottom surface.

The apparatus can include comprising a heel stop attached to the aft end of the planar platform and positioned orthogonal to the planar platform.

The adjustable fastener can be a screw configured to be tightened to secure the balancing rail into a selected position and to be loosened to slide the balancing rail from one side to the other side of the planar platform.

A cross-section of the balancing rail is rectangular, wherein a top flat surface of the rail abuts against the bottom of the planar platform and a bottom flat surface of the rail in contact with the ground.

The apparatus can include a level traction layer connected to the bottom flat surface of the rail and configured to increase a friction coefficient between the bottom flat surface and the ground.

The apparatus can include at least one adjustable strap connected to the planar platform and configured to position and hold the shoe on a top surface of the planar platform.

The apparatus can include a plurality of fastening points configured to engage the at least one adjustable strap, wherein each fastening point is on the planar platform and set at a different width.

The balancing rail can be secured onto a medial side of the bottom surface of the platform producing a medial position configured for eversion of the ankle to strengthen the muscles on the lateral side of the ankle.

The balancing rail can be secured onto a lateral side of the bottom surface of the platform producing a lateral position configured for inversion of the ankle to strengthen the muscles on the medial side of the ankle.

The balancing rail can be secured onto the bottom of the platform on a centerline along the length of the platform producing a neutral position configured to strengthen the muscles on both sides of the ankle.

Various embodiments provide an adjustable ankle rehabilitation apparatus configured for engagement onto a foot. The apparatus comprising: a sole plate having a length and a width; a pair of parallel channels through the sole plate and positioned along the width of the sole plate; a moveable balance beam along a length of the sole plate and positioned transverse to the pair of parallel channels; a pair of threaded holes disposed into a top surface of the balance beam and spaced for alignment with the parallel channels; a pair of fasteners sized for engagement with the threaded holes; and at least one adjustable strap connected to the sole plate and configured to releasably secure a bottom of a shoe to the top surface of the sole plate.

A cross-section of the balance beam is rectangular, wherein the top flat surface of the balance beam abuts against a bottom surface of the sole plate and a bottom flat surface of the balance beam configured for contact with a walkable surface.

The balance beam has a length extending from a front edge of the sole plate to a heel portion of the sole plate.

The balance beam can include a first rounded surface connecting the bottom flat surface to a front surface of the balance beam and a second rounded surface connecting the bottom flat surface to a rear surface of the balance beam.

The balance beam can include two rounded surfaces connecting the bottom flat surface to each side surface of the balance beam.

The sole plate can include a heel stop on a rear portion of the sole plate and positioned perpendicular to a top surface of the sole plate.

Various embodiments provide an ankle strengthening and rehabilitation device. The device comprising: a foot plate comprising a first channel in a transverse position in front of a foot area and extending across a portion of a width of the foot plate and a second channel in a transverse position at the heel area and extending across a portion of the width of the foot plate; a balance bar; a pair of fasteners configured to connect the balance bar to the foot plate through the first and the second channels and to secure the balance bar along a longitudinal axis on a bottom surface of the foot plate, the pair of fasteners configured to loosen the balance bar for selectively positioning along the transverse portion of the channels onto a second longitudinal axis, and to secure the balance bar in a selected position; and at least one attachment mechanism configure for securing a foot onto a top surface of the foot plate.

The first channel and the second channel are each configured with a slot extending through the footplate, the slot being bounded by a recessed peripheral rim. The fastener can be set within and adapted to slide along the recessed peripheral rim.

The balance bar can extend from the front edge of the foot plate and past the second channel to a mid-heel area. A cross-section of the balance bar is rectangular. A top flat surface of the balance bar abuts against a bottom surface of the footplate and a bottom flat surface of the balance bar configured for contact with a walkable surface.

The device can include a level traction layer connected to the bottom flat surface of the rail and configured to increase friction of the bottom flat surface.

As used herein, the word "exemplary" means "serving as an example, instance, or illustration." Any implementation described herein as "exemplary" is not necessarily to be construed as preferred or advantageous over other implementations, nor is it intended to be construed as a model that must be literally duplicated.

As used herein, the phrase "at least one of A, B, and C" can be construed to mean a logical (A or B or C), using a non-exclusive logical "or," however, can be contrasted to mean (A, B, and C), in addition, can be construed to mean (A and B) or (A and C) or (B and C). As used herein, the phrase "A, B and/or C" should be construed to mean (A, B, and C) or alternatively (A or B or C), using a non-exclusive logical "or."

It should be understood that steps within a method may be executed in different order without altering the principles of the present disclosure. For example, various embodiments may be described herein in terms of various functional components and processing steps. It should be appreciated that such components and steps may be realized by any number of hardware components configured to perform the specified functions.

While the foregoing detailed description will provide those skilled in the art with a convenient road map for implementing various embodiments of the invention, it should be appreciated that the particular embodiments described above are only examples, and are not intended to limit the scope, applicability, or configuration of the invention in any way. To the contrary, various changes may be made in the function and arrangement of elements described without departing from the scope of the invention.

The invention claimed is:

1. An adjustable ankle rehabilitation apparatus configured for attachment to a shoe, the apparatus comprising:

a sole plate having a length dimension and a width dimension;

a pair of parallel channels extending through the sole plate and positioned along the width dimension of the sole plate;

a moveable balance beam having a flat top surface and configured for attachment along the length dimension of the sole plate perpendicularly to the pair of parallel channels;

a pair of threaded holes disposed in a top surface of the balance beam and aligned with the parallel channels;

a pair of fasteners configured for engagement with the threaded holes; and an adjustable strap connected to the sole plate and configured for attachment to a bottom of a shoe.

2. The apparatus according to claim 1, wherein the balance beam comprises a rectangular cross-section, wherein the top flat surface of the balance beam is configured to abut against a bottom surface of the sole plate and a bottom flat surface of the balance beam is configured for contact with a walkable surface.

3. The apparatus according to claim 1, further comprising a heel stop on a rear portion of the sole plate and positioned perpendicular to a top surface of the sole plate.

4. The apparatus according to claim 1, wherein the balance beam comprises a first rounded surface connecting the bottom flat surface to a front surface of the balance beam and a second rounded surface connecting the bottom flat surface to a rear surface of the balance beam.

5. The apparatus according to claim 1, wherein the balance beam comprises two rounded surfaces connecting the bottom flat surface to each side surface of the balance beam.

* * * * *